United States Patent [19]

Buckner

[11] Patent Number: 4,671,260

[45] Date of Patent: Jun. 9, 1987

[54] ORAL EXERCISER FOR FACE, CHIN AND NECK, AND MEDICAL APPLIANCE

[76] Inventor: Horst Buckner, 13720 Hillcrest, Dallas, Tex. 75240

[21] Appl. No.: 760,242

[22] Filed: Jul. 29, 1985

[51] Int. Cl.[4] ..... A61F 5/08

[52] U.S. Cl. ..... 128/76 R; 128/12; 272/95

[58] Field of Search ..... 272/94, 95; 128/25 R, 128/76 R, 12, 76 B, 13–20, 136, 137; 433/5, 6, 7

[56] References Cited

U.S. PATENT DOCUMENTS

| | | | |
|---|---|---|---|
| 959,684 | 5/1910 | Adelman | 128/12 |
| 1,363,534 | 12/1920 | Rogers | 128/76 R |
| 2,061,936 | 11/1936 | Engelfried | 128/12 |
| 3,895,624 | 7/1975 | Georgiabe | 128/76 R |
| 3,916,880 | 11/1975 | Schroer | 128/12 |
| 3,938,508 | 2/1976 | Buckner | 128/76 R |
| 4,002,162 | 1/1977 | Whisser | 128/17 |

FOREIGN PATENT DOCUMENTS

| | | | |
|---|---|---|---|
| 86583 | 9/1895 | Fed. Rep. of Germany | 128/12 |

*Primary Examiner*—Richard J. Apley
*Assistant Examiner*—John Welsh
*Attorney, Agent, or Firm*—Jerry W. Mills; Roger N. Chauza

[57] ABSTRACT

A facial exerciser is disclosed, for exercising the musculature of the face, chin and neck. A pair of spreader bar shanks (18, 22) each have fixed at the ends thereof a lip engaging piece (12, 14) and a coupler (20, 24). Each coupler (20, 24) includes an open groove (42, 44) into which the other shank is snapped, thereby connecting the shanks (18, 22) together in parallel, and allowing the shanks to slideably move with respect to each other. Each coupler (20, 24) includes a creased outer edge (46, 48) for holding an elastic band (26) so that the lip engaging pieces (12, 14) are elastically biased apart, thereby offering resistance to the constriction of a person's lips.

12 Claims, 6 Drawing Figures

ORAL EXERCISER FOR FACE, CHIN AND NECK, AND MEDICAL APPLIANCE

TECHNICAL FIELD OF THE INVENTION

The present invention relates in general to an oral appliance, and more particularly relates to facial, chin and neck muscle and tissue exercise apparatus.

BACKGROUND OF THE INVENTION

Special emphasis is currently placed on an individual's appearance. It is well known that exercise stimulates the musculature of the body and increases the blood flow thereby keeping a person healthy. Of particular importance is the health and appearance of a person's face—the feature most visible to others. It is not surprising, therefore, that large amounts of money are spent to maintain a youthful appearance. Moreover, facial exercises are essential to prevent the disfigurement of tissue damaged as a result of burns around the mouth (microstomia) or severe lacerations.

Many cosmetic lotions, creams and solutions are marketed with the stated purpose of preventing facial wrinkles, age spots and color fading. The results of these aids are questionable at best. Disclosed in U.S. Pat. No. 3,938,508 is an oral appliance for preventing shrinkage of the tissue around a person's mouth because of facial burns. The appliance in the noted patent is mechanically adjustable and thus primarily adapted for clamping the lips of a person a fixed distance apart.

From the foregoing, it may be seen that a need has arisen for an effective mouth exerciser which offers an elastic resistance to lip constriction, and which is easily inserted or removed from the mouth, or disassembled for cleaning.

SUMMARY OF THE INVENTION

In accordance with the invention, a facial exerciser is provided which substantially eliminates or reduces the problems associated with the prior apparatus.

The facial exerciser of the invention includes a pair of concave plastic lip engaging pieces for engaging an individual's lips at diametric locations in the mouth opening. Each lip engaging piece is fixed to an end of respective slightly curved stainless steel spreader bars. The spreader bars are detachably and slideably connected together, and tensioned by an elastic band such that the end pieces can be forced together by the constriction of a person's lips.

The slideable connection between the spreader bars is provided by a plastic coupler fixed to an end of each spreader bar. Each coupler is grooved for slideably receiving therein the other spreader bar. Thus, each spreader bar is slideably connected together, whereby the lip pieces can be compressibly slid together, or relaxed to spread the lips. In addition, one spreader bar being snappable into the groove of the other spreader bar coupler, and vice versa, facilitates the assembly of the appliance, or disassembly thereof.

The elastic band is routed around each coupler, and is elastically tensioned by the constriction of the lip engaging pieces by an individual's lips. In this manner, the facial muscles are exercised by the resistance to the compression of the facial exerciser.

BRIEF DESCRIPTION OF THE DRAWINGS

Further features and advantages of the invention will become apparent from the description of an illustrative embodiment thereof, taken in conjunction with the accompanying drawings, in which.

DETAILED DESCRIPTION OF THE INVENTION

Figure 1:
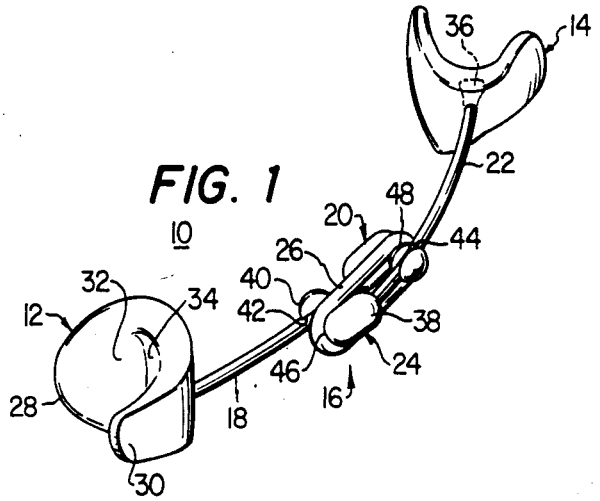
FIG. 1 is an isometric view of the facial exerciser constructed according to the invention.

Referring to FIG. 1 of the drawings, there is shown the facial exerciser appliance generally designated 10, in a slightly compressed state. The facial exerciser 10 includes a first lip engaging piece 12 and a diametrically disposed second lip engaging piece 14. Lip engaging pieces 12 and 14 are detachably connected together by a spreader bar assembly 16. The assembly 16 includes a first spreader bar shank 18 integral at one end thereof with the first lip engaging piece 12, and integral at the other end thereof with a first coupler 20. The spreader bar assembly 16 further includes a second spreader bar shank 22 made comparably integral with both the second lip engaging piece 14 and a second coupler 24. Spreader bar assembly couplers 20 and 24 are held in tension together by an elastic band 26.

In more detail, each lip engaging piece 12 and 14 includes a major lobe 28 and a minor lobe 30 joined together so as to form a concave area 32 engageable either with a person's lips, or the commissure of the mouth. A saddle part 34 of the connection between lobes 28 and 30 is gently rounded to provide a uniform distribution of pressure on the user's mouth, irrespective of the orientation of the appliance 10 therein. The concave area 32 accommodates the curvature of a person's lip such that the exerciser 10 cannot be easily dislodged from the mouth opening.

The lip engaging pieces 12 and 14, as well as the spreader bar couplers 20 and 24, are constructed of a self-lubricating plastic, such as polypropolene. While other suitable materials may be used, polypropolene is durable, easy to clean, and provides enhanced slideability between the spreader bar and the plastic coupler.

The spreader bar shanks 18 and 22 are preferably constructed of stainless steel to provide a sanitary and corrosion resistant connection between the lip engaging pieces and the associated couplers, aas well as providing a rigid interconnecting member. Alternatively, to provide a corrosion-resistant surface, the metal spreader bar shanks 18 and 22 may be chrome plated. Each of the plastic lip engaging pieces 12 and 14, and the couplers 20 and 24, are made integral to the respective spreader bar shanks 18 and 22 by flattening each end of both spreader bars into a swallowtail 36, as shown by the dashed lines. The plastic lip engaging pieces 12 and 14, and the couplers 20 and 24, are then molded around the swallowtail ends 36. This shaping of the spreader bar shank ends prevents the plastic pieces from rotating or falling off the spreader bars, should such pieces become loosened. With current plastic injection molding techniques, it is possible also to mold the lip engaging piece 12, the shank 18 and the coupler 20 as a unitary piece. The corresponding other parts of the appliance would be comparably constructed.

FIG. 1 further illustrates that the shank 18 and 22 of each spreader bar is slightly curved and attached together with couplers 20 and 24 for slideable movement. The radius of the spreader bar shanks is made to correspond with the path taken by the lips of a person when constricted and relaxed. In addition, with each spreader bar shank 18 and 22 constructed with a large radius of curvature, there is less frictional sliding resistance within the respective coupler grooves.

As noted in FIG. 1, spreader bar coupler 24 includes a first nodule 38 integral with a second nodule 40. First nodule 38 is made integral with spreader bar shank 22 as noted above, while the second nodule 40 includes an open groove 42 into which the spreader bar shank 18 is snapped and made slideable. Coupler 20 is comparably constructed with open groove 44. Each spreader bar coupler 20 and 24 has formed on the terminal end thereof a respective crease 46 and 48 for receiving and holding therein the elastic band 26. In this manner, the elastic band 26 cannot be easily dislodged during expansion and contraction of the appliance.

Figure 2:
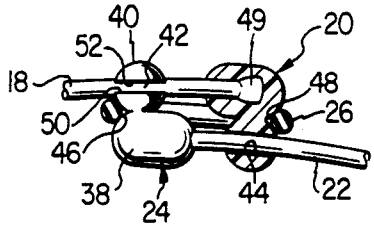
FIG. 2 is a partial cross-sectional view of the spreader bar couplers.

Referring to FIG. 2, there are shown spreader bar couplers 20 and 24 in considerably more detail. Nodule 40 has formed therein the open groove 42 into which the spreader bar shank 18 is snapped. The groove 42 is open at its top, but includes peripheral edges 50 and 52 which partially envelope spreader bar shank 18. With this arrangement, the spreader bar shank 18 is longitudinally slideable within the coupler groove 42, but can be removed by unsnapping it from the groove 42.

The crease 46 formed at the juncture of the first nodule 38 and second nodule 40 is clearly shown in FIG. 2. It can be seen that with a similar crease 48 in coupler 20, the elastic band 26 is lodged therein and holds the couplers 20 and 24 together in elastic compression. The end of spreader bar shank 18 is shown with a swallowtail end 49 embedded within the plastic coupler 20.

It should be noted that with the coupler 24 constructed of a self-lubricating plastic, there is a low degree of friction between the open groove 42 and spreader bar shank 18. This feature makes the compression resistance of the exerciser appliance essentially dependent upon the elasticity of the band 26. The smooth uninterrupted surface area of the spreader bar shanks 18 and 22 moving within the respective grooves 42 and 44 of the self-lubricating plastic couplers present a decided advantage over the device of the noted patent.

Figure 3:
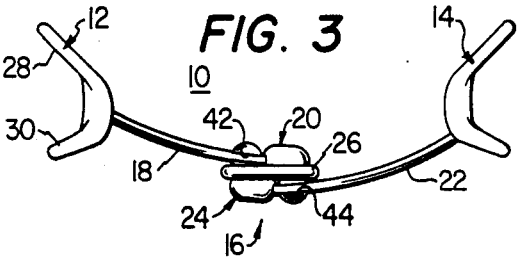
FIG. 3 is a top view of the facial exerciser in its relaxed state.

With reference to FIG. 3, the exerciser appliance 10 is shown relaxed as it would appear when the elastic band 26 pulls the couplers 20 and 24 together. It is seen that when the elastic band 26 is stretched by mouth or lip constriction, resistance is offered to the compression of the exerciser appliance. The facial muscles are thereby exercised, and in microstomia cases, pressure is continuously applied to the mouth opening to prevent closure thereof during the healing process.

Depending upon the elasticity of the band 26, the facial exerciser appliance 10 can be compressed until the couplers 20 and 24 abut against the backside of respective lip engaging pieces 14 and 12. Because the facial exerciser appliance of the invention can then be easily disassembled, elastic bands of various elasticities can then be interchanged to vary the compressive properties of the device. In severe cases of microstomia, where the mouth opening is very narrow, the appliance can be disassembled before insertion into the mouth opening. The elastic band 26 is placed loosely around one of the spreader bar shanks. The major and minor lobes 28 and 30 can then be engaged with the commissures of the mouth opening. The spreader bar shanks are then positioned with one's fingers so that the shanks 18 and 22 are snapped into respective grooves 42 and 44 of the couplers 20 and 24. The elastic band 26 is then placed around the couplers 20 and 24.

From the foregoing, it is seen that the length of each spreader bar shank 18 and 22 primarily determines the narrowest length to which the exerciser may be compressed before the couplers and lip engaging pieces abut. Accordingly, facial exerciser appliances may be provided with different length spreader bar shanks to accommodate different sized mouths.

Figure 4:
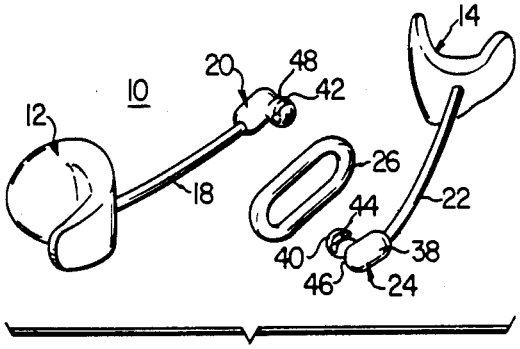
FIG. 4 is a disassembled view of the invention, illustrating the grooved spreader bar couplers.

FIG. 4 illustrates the facial exerciser appliance 10 as it would appear when disassembled. In accordance with a primary feature of the invention, the facial exerciser 10 may also be easily disassembled for cleaning or disassembled to replace the elastic band with a new one, or with one of a different elasticity. The creases 46 and 48 for lodging the elastic band 26 therein circumscribe the coupler where the first nodule 38 joins the second nodule 40. In assembling the facial exerciser appliance 10, the elastic band 26 is first placed around one of the spreader bar shanks. The spreader bar shanks 18 and 22 are then snapped into the open grooves 42 and 44 of the corresponding couplers. Lastly, the elastic band is stretched and placed into the creases 46 and 48.

Figure 5:
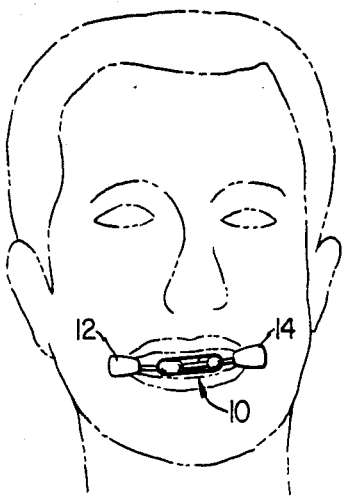
FIG. 5 illustrates the lateral placement of the facial exerciser between an individual's lips for exercising certain facial muscles.

With reference to FIG. 5 there is shown the facial exerciser appliance 10 of the invention disposed horizontally in the mouth opening of a user and engaged with the commissures of the month. Facial exercising with the device disposed as shown is accomplished by bringing the commissure areas of the mouth together, thereby forming an "O" with the lips. This is also the position of the exerciser appliance 10 when used in connection with microstomia for providing continuous expansion pressure to the commissures.

Figure 6:
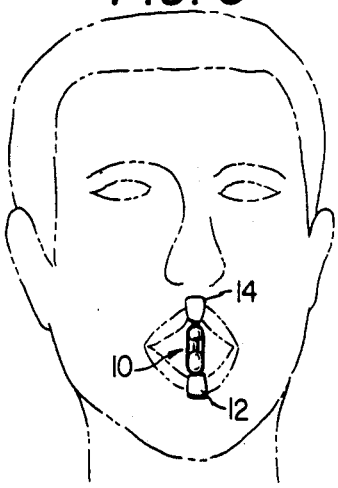
FIG. 6 illustrates the facial exerciser applied in a vertical position between an individual's lips, thereby exercising other facial muscles.

FIG. 6 illustrates the oral position of the facial exerciser 10 when disposed vertically in the mouth opening. In this position, a different set of facial muscles are exercised. Diagonal placement, and many other angular positions of the exerciser 10 within the mouth opening are desirable to exercise other muscle groups.

From the foregoing, it can be seen that a very effective, economical and easily manufacturable facial exerciser is provided. In addition, the facial exerciser is constructed so as to be quickly and easily disassembled.

Although the invention has been described above with a certain degree of particularity with respect to the components and arrangements thereof, it should be understood that this disclosure has been made by way of understood that this disclosure has been made by way of example only. Consequently, changes in the details of the construction and in the arrangement of the elements will be apparent to those familiar with the art, and may be resorted to without departing from the scope of the invention as claimed below.

What is claimed is:

1. In a facial exerciser adapted for oral use, and of the type having lip engaging pieces for engaging the lips of a person's mouth, and expandable means for expanding and biasing said lip pieces apart, the improvement comprising:

spreader bar means comprising a pair of shanks directly connected together for slideable movement, each said shank being connected to a different said lip engaging piece, and for slideable compression against said biasing, thereby providing resistance to lip constriction; and means mounted on each shank for detachable connection of said shanks so as to enable detachment of one said shank from the other, and said detachable means including a groove for snapping therein each said shank.

2. The facial exerciser of claim 1, wherein said expandable means includes an elastic band biasing each said lip engaging piece apart.

3. The facial exerciser of claim 2 wherein said expandable means includes a creased part for holding said elastic band therein.

4. The facial exerciser of claim 1 wherein said means for detachable connection is constructed of a material dissimilar to that of the shank.

5. The facial exerciser of claim 4 wherein said means for detachable connection is constructed of a self-lubricating plastic and said shank is constructed of stainless steel.

6. The facial exerciser of claim 1 wherein each lip engaging piece and associated shank and means for detachable connection are molded of one material to form a unitary article.

7. An oral appliance for exercising facial tissue, comprising:

a pair of lip engaging pieces, each with a concave part for receiving therein a portion of a user's mouth opening;

a pair of movable spreader bars, each connected to a different one of said lip engaging pieces;

copuler means mounted to each spreader bar for directly connecting one said spreader bar to the other so that one said spreader bar can slideably move in a path generally parallel with respect to the other spreader bar to expand and contract said appliance, and wherein said each coupler means is fixed to one said spreader bar and is removably detachable to the other spreader bar by snap fitting so that the spreader bars can be detached from each other at any slideable position whether expanded or contracted; and bias means for biasing said spreader bars to said expanded position.

8. The oral appliance of claim 7 wherein said coupler means is grooved for providing slideable movement of said spreader bars therein, and for detachment of one said spreader bar therefrom.

9. The oral appliance of claim 8 wherein said groove is partially open for snapping therein one said spreader bar.

10. An oral appliance for exercising facial tissue, comprising:

a pair of lip engaging pieces, each with a concave part for receiving therein a portion of a user's mouth opening;

a pair of movable spreader bars, each connected to a different one of said lip engaging pieces; and coupler means mounted to each spreader bar and having a partially open groove for snapping therein the other respective said spreader bar and for detachably connecting said spreader bars so that one said spreader bar can be disconnected from the other, and for providing slideable movement of one said spreader bar with respect to the other said spreader bar.

11. The oral appliance of claim 10 wherein said coupler means is constructed of a self-lubricating plastic.

12. The oral appliance of claim 10 and further comprising means for biasing said spreader bars away from one another.

* * * * *

UNITED STATES PATENT AND TRADEMARK OFFICE

CERTIFICATE OF CORRECTION

PATENT NO. : 4,671,260

DATED : June 9, 1987

INVENTOR(S) : Horst Buckner

It is certified that error appears in the above-identified patent and that said Letters Patent is hereby corrected as shown below:

Column 2, line 56, change "aas" to --as--.

Column 4, line 59, delete "understood that this disclosure has been made by way of".

Column 5, line 38, change "copuler" to --coupler--.

Signed and Sealed this

Third Day of November, 1987

*Attest:*

DONALD J. QUIGG

*Attesting Officer*

*Commissioner of Patents and Trademarks*